United States Patent [19]

Grisz

[11] Patent Number: 4,776,760

[45] Date of Patent: Oct. 11, 1988

[54] REINFORCED RUBBER LINER FOR CENTRIFUGAL PUMP CASINGS

[75] Inventor: Eugene J. Grisz, Astin, Pa.

[73] Assignee: Baker International Corporation, Orange, Calif.

[21] Appl. No.: 872,529

[22] Filed: Jun. 10, 1986

Related U.S. Application Data

[63] Continuation-in-part of Ser. No. 742,928, Jun. 10, 1985, abandoned.

[51] Int. Cl.[4] ..... F04D 29/02

[52] U.S. Cl. ..... 415/197; 415/128

[58] Field of Search ..... 415/128, 200, 196, 197, 415/219 R, DIG. 5

[56] References Cited

U.S. PATENT DOCUMENTS

| | | | |
|---|---|---|---|
| 3,018,736 | 1/1962 | Clay | 415/197 |
| 3,094,075 | 6/1963 | Logue | 415/197 |
| 3,450,594 | 6/1969 | Hennessy | 428/413 |
| 3,607,592 | 9/1971 | Jenkins | 415/197 |
| 3,607,600 | 9/1971 | Schreter | 415/197 |
| 4,120,605 | 10/1978 | Hurst | 415/197 |
| 4,234,291 | 11/1980 | Hurst et al. | 415/197 |

FOREIGN PATENT DOCUMENTS 2100870 7/1972 Fed. Rep. of Germany .

OTHER PUBLICATIONS

Article titled "Fiberglass-Reinforced Plastics Desknook" by Nicholas P. Cheremisinoff & Paul N. Cheremisinoff (pp. 217-218).

*Primary Examiner*—Robert E. Garrett
*Assistant Examiner*—John T. Kwon
*Attorney, Agent, or Firm*—Trask, Britt & Rossa

[57] ABSTRACT

A half-shell rubber lining for a centrifugal pump reinforced in selective regions of its outer surface with an adhesively bonded fabric mesh impregnated with a thermoset resin is disclosed.

9 Claims, 2 Drawing Sheets

REINFORCED RUBBER LINER FOR CENTRIFUGAL PUMP CASINGS

RELATED APPLICATIONS

This application is a continuation-in-part of application Ser. No. 742,928, filed June 10, 1985, now abandoned.

BACKGROUND OF THE INVENTION

1. Field

This invention relates to elastomeric linings for casings of centrifugal pumps and particularly to rubber linings, especially natural rubber linings, which are constructed to prevent collapse during use.

2. State of the Art

Elastomeric linings, including rubber linings, and in particular, natural rubber linings, have been used for quite some time in centrifugal pumps, both as liners and as coverings on impellers so that the pumps could effectively handle abrasive slurries and corrosive liquids such as acids. The basic function of a liner is to provide a resistant surface to interface with fluids directed through the pump which may be abrasive or corrosive in nature. In constructing these surfaces, elastomers are often selected as fabrication materials because they exhibit these particular resistant qualities. In selecting elastomeric material, a materials problem arises in that elastomers are not sufficiently rigid in structural configurations to withstand the pressures created under pumping conditions, absent some secondary support structure. As a result, a common construction includes an outer rigid casing fabricated of some type of metal or plastic associated with an inner liner fabricated of an elastomer. Metal casings are required in situations wherein the pumping is done under high pressure conditions. The plastic casings are unsuitable for high pressure and are mainly employed for low pressure pumping conditions.

Occasionally, during use, the pump lining will collapse, that is, the rubber lining will pull away from the casing of the pump. This phenomenon is especially critical in pumps which function in high pressure environments. If this happens in a region proximate to the impeller, the impeller may chew up the lining and render the pump disabled. Even if the lining pulls away from the casing in the discharge region or in the throat region without interfering with the impeller, the sagging lining may impede flow and make the pump less effectual.

One technique for precluding the collapse of rubber linings in a large centrifugal pump is to adhere the whole outer surface of the lining to the pump casing. In U.S. Pat. No. 3,607,600 (Schreter), a method of bonding an elastomer liner to a rigid synthetic resin (plastic) casing is disclosed. The method involves casting the liner and casing as an integral unit by first laying elastomer in a mold, subsequently laying a blanket of chopped fibers over the elastomer and then applying successive layers of synthetic resin over the fibers. The synthetic layer is rolled to effect a composite layer of resin and elastomer in the interfacial region between the elastomer and resin materials. The chopped fiber extends into both the elastomer and the synthetic resin in order to provide a mechanical linkage of those two layers. In this manner, the lining is held fast to the casing so that it cannot collapse due to negative pressure within the pump.

Other attempts in this area have included the adhesion of a conventional liner to the interior of a metal casing. In this approach, the liner is coated with adhesives on its outermost surface and that surface is then abutted against the interior wall of the metal casing to form a bond.

However, neither of these techniques are generally desirable inasmuch as pump linings require periodic replacement due to the liner being worn away after extended use.

The liner/casing assembly of Schreter would require a complete replacement of the total liner and casing assembly. This replacement could prove excessively expensive. Furthermore, Schreter's assembly is not suitable for use in high pressure environments wherein metal casings are a prerequisite.

In the case of the metal casings having liners adhesively secured thereto, it is difficult to remove a lining which has been firmly adhered to the pump casing. Thus, the replacement of a lining in such an instance requires much longer time than usual and results in the pump and the system that it services being down for a long period of time.

In certain regions of the lining, for example, in the discharge nozzle, it would be possible to prevent collapse of the lining by inserting a circular, expandable band on the inside of the lining. While such a structure may prevent lining collapse, it would tend to act as an orifice, thereby restricting flow, and would tend to be eroded or corrode with time, failing before the lining failed and contributing some contamination to the liquid medium being pumped.

The problem of collapsing linings is particularly acute with soft, natural rubber pump linings which are frequently preferred in pumps handling abrasive slurries and the like. Because natural rubber is soft, it has less inherent strength than many types of pump liners. Attempts to reinforce natural rubber liners with steel mesh and the like have not been successful. Steel is difficult to prepare with no oxide layer on its surface, which tends to interfere with adhesion between the rubber and the steel. The use of brass mesh overcomes the oxide problem, but has different thermal expansion properties than rubber and thus poses another problem. Since the rubber lining normally shrinks during the curing process, the presence of brass mesh does not permit the rubber lining to shrink according to its normal manner. As a result, a reinforced rubber lining made from a particular mold no longer fits the pump casing since the lining does not shrink as it normally does.

The end result is that preexisting molds cannot be used to produce reinforced liners for the respective casings formerly supplied by nonreinforced liners produced from the same molds. The same problem is encountered with the use of hard rubber as an outer surface for the lining inasmuch as hard rubber does not shrink during curing to the same extent as soft natural rubber. Thus, from a particular mold size the lining no longer fits the casing.

If such techniques were used to reinforce a pump liner, then new molds would have to be prepared whereby the mold was of a size and a design to provide a pump lining suitable for placement within a pump casing without any shrinkage of that lining. However, even such an approach may not be successful inasmuch as it would be necessary to reinforce the whole lining in such an instance so that there is no shrinkage throughout the lining. Also, if the rubber were prevented from shrinking during curing, it would tend to be in tension in the cured lining, subjecting the rubber to faster potential wear.

SUMMARY OF THE INVENTION

The instant invention relates to a half-shell lining for centrifugal pumps wherein the lining is made of a natural rubber and reinforced in selective regions with a resin impregnated fabric which permits the rubber to shrink its normal amount during curing.

The invention involves lining a mold with thermosetting resin impregnated fabric in those regions in which it is desired to reinforce a rubber lining made in said mold. Typically, the impregnated fabric is placed several or more layers thick in the region to be reinforced. Once the fabric sheets are in place, the last or outermost layer of fabric sheets is coated with an adhesive adapted for bonding fabric to elastomers, especially rubbers. The elastomer is then positioned within the mold. Typically, the elastomer is in the form of sheets which are placed within the mold, including over the adhesive-coated fabric sheets. The mold is then closed and subjected to compression over a preselected time interval. The rubber, adhesive and the thermoset impregnated fabric is cured for a time and at a temperature sufficient to bring about both curing of the rubber and the resin.

The instant invention is particularly advantageous inasmuch as linings may be molded in molds already sized to accommodate for shrinkage of the elastomer material during molding so that the finished liner will fit within the intended pump casing. Also, the elastomer can be cured for substantially the same time and substantially the same temperature as it is usually cured so that a fully cured liner results. Furthermore, the invention provides reinforcement at the desired location (i.e., at the outside surface of the liner) so that the liquid within the pump sees only the erosion and corrosion resistant liner surface.

The thermosetting resin impregnated mesh sheets are generally placed in the molds so that a substantially complete arch is formed as an exterior surface of the lining or at least as much as an arch as possible so that optimum resistance to collapse is obtained with a minimum thickness of fabric layers.

This maintenance of a minimum fabric layer thickness is important in that the space within a closed mold is limited. By keeping the fabric layer thin, the remaining thickness of the liner can be allocated to the elastomer. Since the rate of erosion of the elastomer over time is the determinant factor in defining the use life of the liner, the thicker such liner can be made, the longer the liner's use life. A principal advantage of the instant invention is that preexisting molds formerly used for nonreinforced liners can be used for fabricating reinforced liners having the same dimensions and shapes as the nonreinforced liners. By retaining the reinforcement layers as thin as possible, the erosion characteristics of the reinforced liner can be made substantially similar to those of a nonreinforced liner as manufactured from the same mold.

DETAILED DESCRIPTION OF THE INVENTION

The instant invention comprises a soft elastomeric liner, particularly natural rubber liners, having unique reinforcement means in selective areas or regions of the liner. Also, the invention comprises a unique process for molding the reinforcing means and the rubber in a single process step in curing the rubber and reinforcing means at a similar temperature for the period of time.

Rubber or elastomeric liners are typically provided for centrifugal pumps which handle either erosive or corrosive media. These pumps are of a very large size having diameters from about 20 inches up to about 60 inches. Although smaller centrifugal pumps having diameters as small as six inches are also provided with liners, the ratio of the liner thickness to liner size is smaller in large pumps which have a greater tendency to collapse, especially if the liner is composed of soft natural rubber.

Though the instant invention is employable in low, as well as high, pressure pumping applications, the invention is especially directed for use in high pressure applications wherein a metal pump casing is prerequisite.

While the casing of the pump provides support for the liner and prevents the liner from being bulged in an outward direction through fluid forces occurring within the pump, generally no means exist for preventing the collapse of the liners if a negative force or pressure occurs within the pump, except the self-supporting structure of the liner itself. Although a negative pressure below atmospheric pressure may occur in the pump, especially in the suction region, for the purposes of the description of this invention, negative pressure is intended to mean a pressure substantially below the usually high pressures within the pump since rapid changes in pressure (hydraulic head) within the pump may occasionally collapse the liner.

The instant invention provides reinforcement means in those regions of the liner which have been found to be most often subject to collapse and to provide such reinforcement means on the outer surface of the liner, that is, that surface of the liner which contacts the casing. Furthermore, the invention provides reinforcing means impregnated with a thermosetting resin which cures within the same temperature range as the natural rubber liner. Further description of the invention may be facilitated by reference to the attached drawings.

Figure 1:
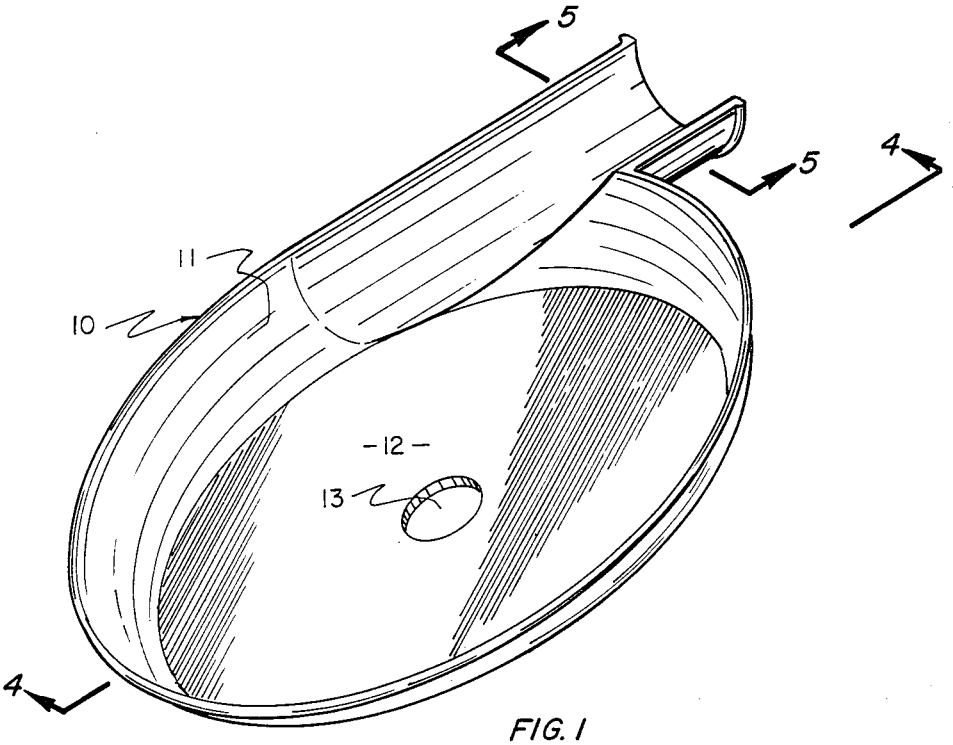
FIG. 1 is a prospective view of the half-shell lining for a centrifugal pump casing.

In FIG. 1, a half-shell elastomeric liner is illustrated in perspective view. A half-shell liner is a large bowl-shaped structure with a central axial aperture. Two half-shell liners are mated to form the lining protecting the entire inner casing of the centrifugal pump. The liner 10 has curved peripheral sidewalls 11 and an integral flat plate-like interior 12 with an aperture 13 which either is a throat opening to admit fluid into the pump or an opening which permits the drive shaft to pass through to connect to the impeller. If the liner has an opening to admit the drive shaft, it is referred to as the engine-side liner while if the opening in the liner is to admit fluid, then it is referred to as the suction-side liner. When a half-shell liner is mated with another half-shell liner the portion of the liner in contact with the casing substantially forms the peripheral surface of a toroid.

Figure 2:
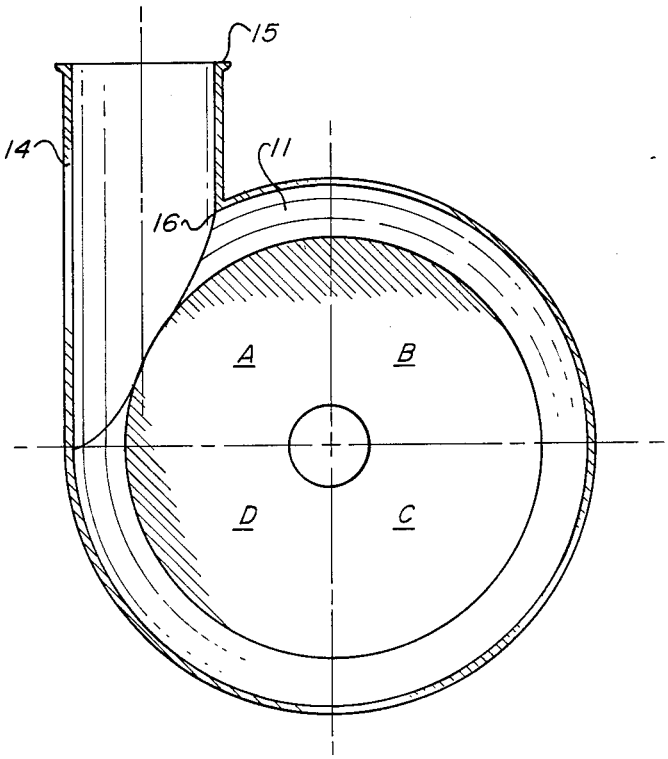
FIG. 2 is an elevational view of an actual lining for a centrifugal pump.

In FIG. 2, a half-shell lining is illustrated in an elevational view with quadrants of the lining being designated A, B, C and D. The lining defines a fluid flow path within the pump casing. As shown in FIG. 1, quadrant A is contiguous to the mounting of the discharge region (nozzle) on the toroidal portion of the liner. Quadrant B is contiguous to quadrant A. As fluid flows through the lining enclosing the fluid flow path, it flows through quadrant B immediately prior to its passage through quadrant A. The fluid then exits through the discharge region. Generally, it is preferred to provide reinforcement in the curved sidewall portions 11 of quadrants A and D of both the engine side and suction side linings. Also, it is preferred to reinforce the discharge region 14 preferably in that portion of the discharge region from the flange 15 to the juncture 16 of the discharge nozzle with the toroidal portion of the liner.

Figure 4:
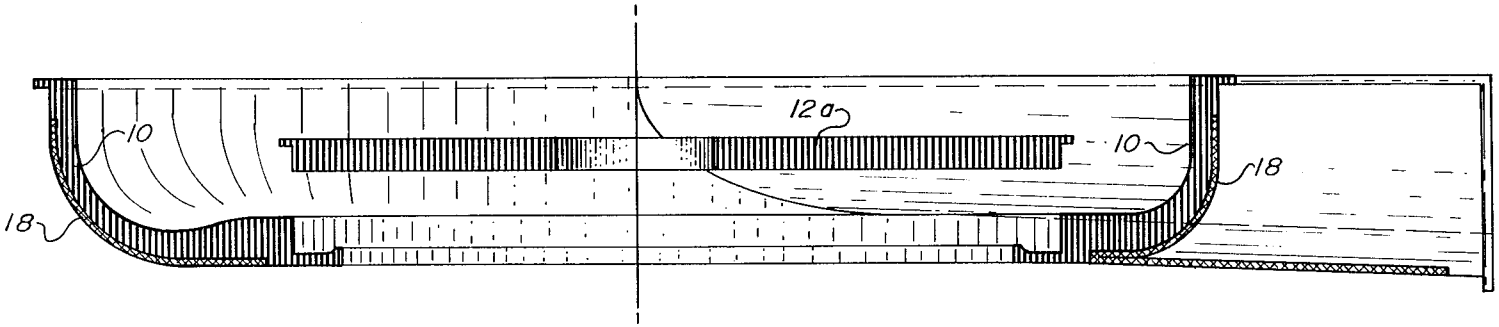
FIG. 4 is an exploded sectional view of the liner of FIG. 1 along section lines 4—4.
Figure 3:
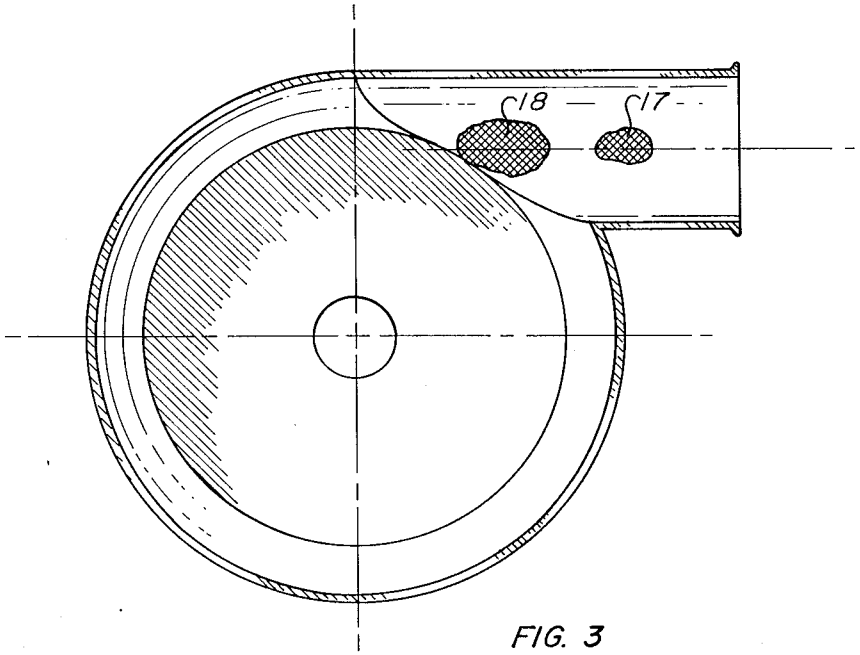
FIG. 3 is an elevational view of a half-shell lining containing zones of reinforcement of said lining being for a centrifugal pump.

In FIG. 3, a liner is illustrated with fabric plys 17 and 18 exposed illustrating the mesh-like nature of the fabric. As shown in FIG. 4, the liner defines a cross-sectional thickness. In those regions of the liner having a reinforcement means applied thereto, the cross-sectional thickness of the liner is constituted by the elastomeric layer and the reinforcement means. In those regions of the liner wherein there is no reinforcement means, the cross sectional thickness is constituted solely by the elastomeric layer.

In FIG. 4, the reinforcement means 17 and 18 is further illustrated. The reinforcement means 17 in the discharge region is substantially a semicylindrical structure substantially thinner in crosssectional thickness than the lining and integral with the external surface of the lining. The reinforcement means 17 is generally at least about three layers thick and may preferably be 10 to 30 layers thick. The reinforcement means may be comprised of a mesh-like fabric impregnated with an uncured thermosetting resin. The mesh configuration may vary from fabrics having a very coarse mesh to fabrics having a very fine, close woven mesh.

In a preferred construction, the reinforcing means comprises an uncured thermosetting resin impregnated in a fine denier nylon mesh fabric. Reinforcing means 18 comprises a similar number of plys of a similar material. Reinforcement means 18 forms about one-half of an arch. The reinforcement means 18 extends completely around the lining substantially reinforcing all the quadrants A, B, C and D, as illustrated in FIG. 2. Full circle reinforcing of large diameter linings may be preferred for many applications.

The linings represented in FIG. 4 are two-piece linings, that is, two pieces are required to form a single half-shell lining. Separate flat disk members, such as member 12*a* shown in FIG. 4, join with the peripheral pieces illustrated in FIG. 4 to form the half-shell liner. Construction of the type shown in FIG. 4 without integral central disk members is frequently used in very large pumps. The separate flat disk-like central members interlock with the peripheral members shown in FIG. 4 to hold the peripheral members in place.

The central disk-like members are usually provided with threaded studs which project through bolt-holes in the casing so that the lining may be securely fixed to the casing.

The reinforcement means in the form of multiple plys may be from about one-tenth to about one-half inch in thickness and preferably is from about two-tenths to about four-tenths inches in thickness, while the thickness of the rubber lining is about three-fourths of an inch to about one and one-half inches and is generally about one to one and one-quarter inches.

The liner may be formed within a mold adapted to be sealed and subjected to compression. The half-shell is reinforced by placing a layer of a plurality of thin sheets impregnated with an uncured thermosetting resin fabric mesh. The regions of the mold in which the reinforcing is intended to be applied to the lining are completely covered with the fabric sheets.

The thickness of the impregnated fabric is generally not greater than about two-hundreths of an inch and the fabric reinforcement is applied in the mold from about three to about thirty plys thick and generally about ten to thirty plys thick. A particular material useful as reinforcement in this invention is a phenolic resin impregnated nylon fabric material which has curing conditions substantially similar to natural rubber and which shrinks about the same amount as natural rubber upon curing. It is identified in the art by MIL-P-15047.

After the fabric has been placed within the mold, the last layer of fabric, i.e., the outermost layer from the mold surface itself, is coated with an adhesive adapted for bonding fabric with elastomers, especially rubbers. Various adhesives, which are well known in the art, may be used. Those adhesives which may be used include compounds comprised of dispersed organic compounds, fillers and isocyanates in organic solvents. Expressed in other terms, adhesives which contain isocyanates or carbimide moieties may be used. Those skilled in the art will appreciate and readily recognize a number of adhesives which would be employable in this context.

In a preferred method, an adhesive sold under the trade designation Chem-Lok 402 or Chem-Lok 310 is used. The central requirement of the adhesive is its compatibility with phenolic resins.

Subsequent to the application of adhesives, the elastomer is laid into the mold. In a preferred construction, the elastomer, e.g., rubber, is in the form of sheets which are laid into the mold over the fabric sheets already within the mold. The rubber sheets retain the fabric sheets in position within the mold. The mold is then closed and subjected to compression over a predetermined time at a preselected temperature. The rubber may be cured at a temperature of about 300° F. for about 3½ hours.

A rubber liner prepared in this fashion has reinforcing means integrally molded in the rubber lining and being that the resin is a thermosetting and relatively rigid material; a strong arch-support is provided in each region in which the lining is reinforced.

It is advantageous to form the linings in this manner of reinforcement inasmuch as existing molds utilized to make non-reinforced linings may be utilized to make reinforced linings whereby the by shrinkage is the same, the linings fit the casings they are intended to fit.

I claim:

1. In a replaceable rubber lining for a centrifugal pump casing, said lining having a volute section and a discharge nozzle mounted on said volute section, the improvement comprising:

semi-cylindrical reinforcement means for reinforcing a discharge nozzle of said lining, said semi-cylindrical reinforcement means including a thermosetting resin impregnated fabric mesh which is adhesively bonded to the external surface of that portion of said lining defining said discharge nozzle of said lining;

semi-arch reinforcement means for reinforcing a region of said lining volute section which is proximate the mounting of said discharge nozzle on said volute section, said semi-arch reinforcement means including a thermosetting resin impregnated fabric mesh which is adhesively bonded to the external surface of that portion of the lining defining the volute section proximate said mounting of said discharge nozzle to said volute.

2. The improvement according to claim 1 wherein said fabric mesh is composed of multiple plys of a resin impregnated fabric.

3. The rubber lining of claim 2 wherein a ply of resin impregnated fabric comprises a loose fabric mesh of nylon filaments impregnated with a phenolic resin.

4. A replaceable half-shell, bowl-shaped, elastomeric, lining for a centrifugal pump casing, said lining comprising a layer of elastomeric material and a resin impregnated mesh-like, substantially rigid reinforcement fabric adhesively bonded to said elastomeric layer, said lining defining a fluid flow path, said lining having a split cylinder discharge nozzle mounted on said bowl shaped lining, said bowl lining being divided into four quadrants: a first quadrant, a second quadrant, a third quadrant, and a fourth quadrant, said first quadrant being contiguous said mounting of said discharge nozzle on said bowl lining, said second quadrant being contiguous said first quadrant, wherein fluid within said fluid flow path passes through said second quadrant immediately prior to its passage through said first quadrant and then exits through said dishcarge nozzle, said reinforcement fabrics, in half-cylinder form, being mounted on said discharge nozzle and on said bowl lining in said first and second quadrants of said bowl lining, wherein a cross-sectional thickness of said lining is constituted by said elastomeric layer except in those regions having reinforcement fabrics bonded thereto said cross-sectional thickness in said regions being constituted by said elastomeric layer and said reinforcement fabrics.

5. The lining of claim 4, wherein said lining defines a curved sidewall, said reinforcement fabrics being adhesively bonded to said curved sidewall of said elastomeric liner.

6. The lining of claim 4, wherein each of said reinforcement fabrics consist of multiple plys of said resin impregnated fabric mesh.

7. The lining of claim 4, wherein said reinforcing fabric mesh forms substantially the outer surface of said lining in those regions in which said reinforcement fabrics is present.

8. The lining of claim 4, wherein said fabric is a nylon material.

9. The lining of claim 4, wherein said resin is a thermosetting phenolic resin.

* * * * *